US009719714B2

(12) United States Patent
Kim et al.

(10) Patent No.: US 9,719,714 B2
(45) Date of Patent: Aug. 1, 2017

(54) REFRIGERATOR AND DEHUMIDIFICATION CONTROL METHOD THEREOF

(75) Inventors: Yong Han Kim, Cheonan-si (KR); Kook Jeong Seo, Hwanseong-si (KR); Jung Won Park, Gwangiu (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 942 days.

(21) Appl. No.: 13/317,690

(22) Filed: Oct. 26, 2011

(65) Prior Publication Data

US 2012/0102984 A1 May 3, 2012

(30) Foreign Application Priority Data

Oct. 28, 2010 (KR) ..... 10-2010-0105694

(51) Int. Cl.
*F25D 29/00* (2006.01)
*F24F 13/06* (2006.01)
(Continued)

(52) U.S. Cl.
CPC ..... *F25D 17/042* (2013.01); *F25D 17/065* (2013.01); *F25D 2317/0411* (2013.01);
(Continued)

(58) Field of Classification Search
CPC ..... F25D 17/06; F25D 17/062; F25D 17/067; F25D 2317/06; F25D 2317/068;
(Continued)

(56) References Cited

U.S. PATENT DOCUMENTS 2,689,110 A * 9/1954 Strickland ..... F25D 11/025 236/44 R
2,717,499 A * 9/1955 Ashby ..... F25C 1/04 249/70

(Continued)

FOREIGN PATENT DOCUMENTS

CN 1355410 6/2002
CN 1560548 1/2005

(Continued)

OTHER PUBLICATIONS

Chinese Office Action issued Dec. 29, 2014 in corresponding Chinese Patent Application No. 201110340048.3.

(Continued)

*Primary Examiner* — Frantz Jules
*Assistant Examiner* — Meraj A Shaikh
(74) *Attorney, Agent, or Firm* — Staas & Halsey LLP

(57) ABSTRACT

A refrigerator and a dehumidification control method thereof to effectively perform both temperature compensation and dehumidification so as to prevent formation of dewdrops in a refrigerating compartment of the refrigerator. The control method includes detecting a temperature of outside air around the refrigerator to judge whether or not the detected temperature corresponds to a low-temperature mode requiring dehumidification, heating a refrigerating compartment by operating a refrigerating compartment heater and a refrigerating compartment fan for dehumidification if the low-temperature mode is judged, cooling the refrigerating compartment by operating a compressor while continuously operating the refrigerating compartment fan, and simultaneously cooling and heating the refrigerating compartment to enable simultaneous implementation of temperature compensation by heating of the refrigerating compartment and (Continued)

dehumidification by cooling of the refrigerating compartment.

9 Claims, 7 Drawing Sheets

(51) Int. Cl.
*F24F 3/14* (2006.01)
*F25D 17/04* (2006.01)
*F25D 17/06* (2006.01)

(52) U.S. Cl.
CPC ..... *F25D 2400/02* (2013.01); *F25D 2700/10* (2013.01); *F25D 2700/122* (2013.01); *F25D 2700/123* (2013.01); *F25D 2700/14* (2013.01)

(58) Field of Classification Search
CPC ..... F25D 21/04; F25D 21/12; F25D 2700/14; F24F 3/153
USPC ..... 62/173, 176.6, 90, 150, 180, 186, 203, 62/228.1, 157, 275, 276, 408, 419, 176.2
See application file for complete search history.

(56) References Cited

U.S. PATENT DOCUMENTS 5,778,147 A * 7/1998 Kim ..... F24F 13/06 392/473
2002/0026803 A1* 3/2002 Inoue ..... F25B 13/00 62/228.3
2004/0107727 A1* 6/2004 Kim ..... F25B 5/04 62/525
2006/0255164 A1* 11/2006 Oppermann ..... F24F 3/14 236/44 C
2006/0272345 A1* 12/2006 Ueno ..... F25B 13/00 62/278
2007/0033956 A1* 2/2007 Kang ..... F25D 17/065 62/151
2010/0011790 A1* 1/2010 Schropp ..... F25D 29/00 62/176.2
2010/0077775 A1* 4/2010 Smith ..... F25D 17/042 62/93
2010/0077791 A1* 4/2010 Kamisako ..... A23L 3/3409 62/373
2010/0107674 A1* 5/2010 Aono ..... B01D 53/265 62/275
2010/0154446 A1* 6/2010 Oh ..... F25D 17/042 62/129
2010/0223944 A1* 9/2010 Tsujimoto et al. ..... 62/264
2012/0042672 A1* 2/2012 Fujihara ..... F24F 3/14 62/157
2012/0079840 A1* 4/2012 Lukasse et al. ..... 62/115

FOREIGN PATENT DOCUMENTS

CN 102080045 6/2011
JP 6-300421 10/1994
JP 2001-174119 6/2001
JP 2010169388 A * 8/2010
KR 10-2006-0006097 1/2006
KR 10-2007-0019815 2/2007

OTHER PUBLICATIONS

Espacenet English Abstract of Chinese Publication No. 1560548, Published Jan. 5, 2005.
Espacenet English Abstract of Chinese Publication No. 102080045, Published Jun. 1, 2011.
Espacenet English Abstract of Chinese Publication No. 1355410, Published Jun. 26, 2002.
Espacenet English Abstract of Japanese Publication No. 2001-174119, Published Jun. 29, 2001.
Espacenet English Abstract of Japanese Publication No. 6-300421, Published Oct. 28, 1994.
Zhang et al. "Application of Intelligent Temperature Compensation Technique in Mechanical Temperature Control Refrigerator", Science and Technology of Household Electric Appliance, 2003 (7), 4 pp.
Korean Patent Abstracts—KIPRIS, Publication No. 10-2006-0006097, published Jan. 18, 2006.
Korean Patent Abstracts—KIPRIS, Publication No. 10-2007-0019815, published Feb. 15, 2007.
Korean Office Action dated Dec. 8, 2016 in corresponding Korean Patent Application No. 10-2010-0105694.

* cited by examiner

REFRIGERATOR AND DEHUMIDIFICATION CONTROL METHOD THEREOF

CROSS-REFERENCE TO RELATED APPLICATIONS

This application claims the benefit of Korean Patent Application No. 10-2010-0105694, filed on Oct. 28, 2010 in the Korean Intellectual Property Office, the disclosure of which is incorporated herein by reference.

BACKGROUND

1. Field

Embodiments of the present disclosure relate to dehumidification control of a refrigerating compartment of a refrigerator.

2. Description of the Related Art

A refrigerator includes a main body having a freezing compartment and a refrigerating compartment separated from each other by an intermediate partition, and doors hinged to the main body to open or close the freezing compartment and the refrigerating compartment respectively. An evaporator and a fan are provided in each of the freezing compartment and the refrigerating compartment to produce cold air and blow the cold air into the freezing compartment or the refrigerating compartment.

As the temperature of outside air drops, heat loss of the refrigerating compartment is gradually reduced and consequently, the refrigerating compartment reaches a preset temperature without cooling. That is, cooling time is gradually reduced. In the case where a watery object is stored in the refrigerating compartment, reduction in the cooling time of the refrigerating compartment causes increase in the humidity of the refrigerating compartment, which results in a great amount of dewdrops formed at a surface of the partition toward the refrigerating compartment. Thus, there is a demand for an improved dehumidification control method to prevent formation of dewdrops in the refrigerating compartment.

SUMMARY

It is an aspect of the present disclosure to effectively perform both temperature compensation and dehumidification of a refrigerating compartment of a refrigerator to prevent formation of dewdrops in the refrigerating compartment.

Additional aspects of the disclosure will be set forth in part in the description which follows and, in part, will be apparent from the description, or may be learned by practice of the disclosure.

In accordance with one aspect of the disclosure, a dehumidification control method of a refrigerator includes detecting a temperature of outside air around the refrigerator to judge whether or not the detected temperature corresponds to a low-temperature mode requiring dehumidification, heating a refrigerating compartment by operating a refrigerating compartment heater and a refrigerating compartment fan for dehumidification if the low-temperature mode is judged, cooling the refrigerating compartment by operating a compressor while continuously operating the refrigerating compartment fan, and simultaneously cooling and heating the refrigerating compartment to enable simultaneous implementation of temperature compensation by heating of the refrigerating compartment and dehumidification by cooling of the refrigerating compartment.

A heating time section of the refrigerating compartment and a cooling time section of the refrigerating compartment may be controlled to partially overlap each other.

The cooling of the refrigerating compartment may be performed if a preset time passes after heating of the refrigerating compartment is begun.

In accordance with another aspect of the present disclosure, a dehumidification control method of a refrigerator includes detecting a temperature of outside air around the refrigerator to judge whether or not the detected temperature corresponds to a low-temperature mode requiring dehumidification, turning off a compressor for a preset time prior to beginning dehumidification if the low-temperature mode is judged, heating the refrigerating compartment by operating a refrigerating compartment heater and a refrigerating compartment fan for dehumidification after the preset time passes, cooling the refrigerating compartment by operating the compressor while continuously operating the refrigerating compartment fan, and simultaneously cooling and heating the refrigerating compartment to enable simultaneous implementation of temperature compensation by heating of the refrigerating compartment and dehumidification by cooling of the refrigerating compartment.

A heating time section of the refrigerating compartment and a cooling time section of the refrigerating compartment may be controlled to partially overlap each other.

The cooling of the refrigerating compartment may be performed if a preset time passes after heating of the refrigerating compartment is begun.

In accordance with another aspect of the present disclosure, a refrigerator includes a compressor to compress a refrigerant, a refrigerating compartment evaporator for cooling of a refrigerating compartment, a refrigerating compartment heater to heat air around the refrigerating compartment evaporator, a refrigerating compartment fan to blow the air around the refrigerating compartment evaporator into the refrigerating compartment, and a control unit to heat the refrigerating compartment by operating the refrigerating compartment heater and the refrigerating compartment fan and cool the refrigerating compartment by operating the compressor while continuously operating the refrigerating compartment fan, the control unit controlling the refrigerator by simultaneously heating and cooling the refrigerating compartment to enable simultaneous implementation of temperature compensation by heating of the refrigerating compartment and dehumidification by cooling of the refrigerating compartment.

The refrigerating compartment evaporator may be located upstream of an air stream generated by rotation of the refrigerating compartment fan and the refrigerating compartment heater may be located downstream of the air stream.

The refrigerating compartment heater may be located upstream of an air stream generated by rotation of the refrigerating compartment fan and the refrigerating compartment evaporator may be located downstream of the air stream.

In accordance with another aspect of the present disclosure, a dehumidification control method of a refrigerator includes detecting a temperature of outside air around the refrigerator to judge whether or not the detected temperature corresponds to a low-temperature mode requiring dehumidification, heating a refrigerating compartment by operating a refrigerating compartment heater and a refrigerating compartment fan after a preset time for first dehumidification passes if the low-temperature mode is judged, cooling the refrigerating compartment by operating a compressor while continuously operating the refrigerating compartment fan, and simultaneously cooling and heating the refrigerating compartment to enable simultaneous implementation of temperature compensation by heating of the refrigerating compartment and dehumidification by cooling of the refrigerating compartment, turning off the compressor for a preset time after completion of the first humidification and before implementation of second dehumidification, and heating the refrigerating compartment by operating the refrigerating compartment heater and the refrigerating compartment fan for second dehumidification after the preset time passes, cooling the refrigerating compartment by operating the compressor while continuously operating the refrigerating compartment fan, and simultaneously cooling and heating the refrigerating compartment to enable simultaneous implementation of temperature compensation by heating of the refrigerating compartment and dehumidification by cooling of the refrigerating compartment.

The first dehumidification and the second dehumidification may be controlled such that a heating time section of the refrigerating compartment and a cooling time section of the refrigerating compartment partially overlap each other.

In each of the first dehumidification and the second dehumidification, the cooling of the refrigerating compartment may be performed if a preset time passes after heating of the refrigerating compartment is begun.

In accordance with a further aspect of the present disclosure, a dehumidification control method of a refrigerator includes heating a refrigerating compartment by operating a refrigerating compartment heater and a refrigerating compartment fan, cooling the refrigerating compartment by operating a compressor while continuously operating the refrigerating compartment fan, and simultaneously cooling and heating the refrigerating compartment to enable simultaneous implementation of temperature compensation by heating of the refrigerating compartment and dehumidification by cooling of the refrigerating compartment.

A heating time section of the refrigerating compartment and a cooling time section of the refrigerating compartment may be controlled to partially overlap each other.

The cooling of the refrigerating compartment may be performed if a preset time passes after heating of the refrigerating compartment is begun.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
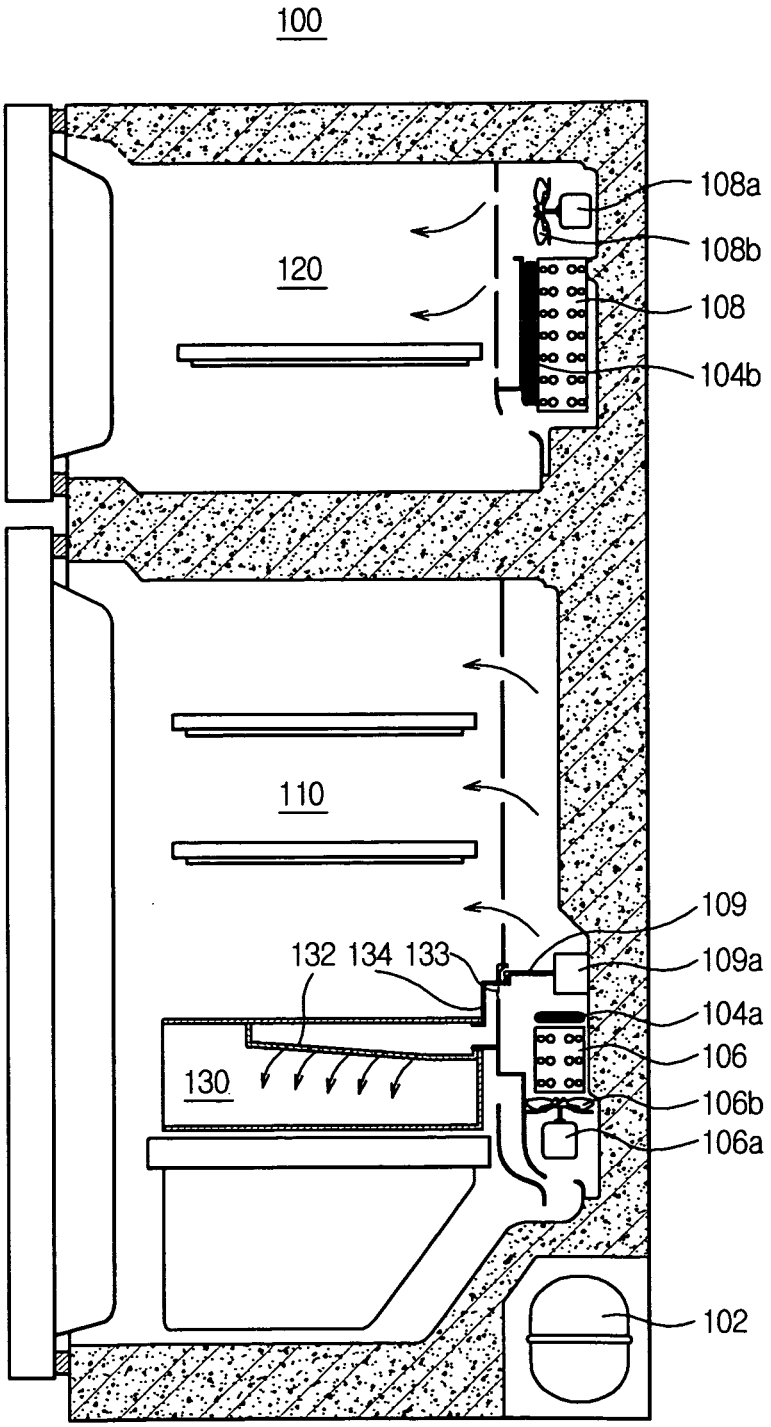
FIG. 1 is a view illustrating a configuration of a refrigerator according to an embodiment of the present disclosure.

Reference will now be made in detail to the exemplary embodiment of the present disclosure, examples of which are illustrated in the accompanying drawings, wherein like reference numerals refer to like elements throughout.

FIG. 1 is a view illustrating a configuration of a refrigerator according to the embodiment of the present disclosure. As illustrated in FIG. 1, the refrigerator 100 according to the embodiment of the present disclosure includes a lower refrigerating compartment 110 and an upper freezing compartment 120.

The refrigerating compartment 110 contains a refrigerating compartment evaporator 106, a refrigerating compartment fan motor 106*a*, a refrigerating compartment fan 106*b*, and a refrigerating compartment heater 104*a*, which are arranged in an innermost cold air generating space thereof (the right region of FIG. 1). The refrigerating compartment heater 104*a* serves to prevent excessive temperature drop in the refrigerating compartment 110 via temperature compensation during dehumidification to control humidity. In a general mode, the refrigerating compartment heater 104*a* also serves to melt and remove frost formed at a surface of the refrigerating compartment evaporator 106. The refrigerating compartment evaporator 106 is located upstream of a blowing direction of the refrigerating compartment fan 106*b*, and the refrigerating compartment heater 104*a* is located downstream of the blowing direction. With this arrangement, as cold air blown by the refrigerating compartment fan 106*b* passes through the refrigerating compartment evaporator 106, the temperature and absolute humidity of the cold air are lowered by dehumidification at the surface of the refrigerating compartment evaporator 106. Then, the cold air is heated to a higher temperature by the refrigerating compartment heater 104*a* (i.e., temperature compensation is performed). Cold air generated from the refrigerating compartment evaporator 106 is blown into the refrigerating compartment 110 by rotation of the refrigerating compartment fan 106*b*. The freezing compartment 120 contains a freezing compartment evaporator 108, a freezing compartment fan motor 108*a*, a freezing compartment fan 108*b*, and a freezing compartment heater 104*b*, which are arranged in an innermost cold air generating space thereof (the right region of FIG. 1). The freezing compartment heater 104*b* serves to melt and remove frost formed at a surface of the freezing compartment evaporator 108. Cold air generated from the freezing compartment evaporator 108 is blown into the freezing compartment 120 by rotation of the freezing compartment fan 108*b*.

Expansion devices (capillary tubes, expansion valves, etc.) (not shown) to depressurize and expand a refrigerant are installed at an entrance of the refrigerating compartment evaporator 106 and an entrance of the freezing compartment evaporator 108. A condenser (not shown) is provided at an exit of a compressor 102. The refrigerating compartment evaporator 106, the expansion device for the refrigerating compartment evaporator 106, the freezing compartment evaporator 108, the expansion device for the freezing compartment evaporator 108, the condenser, and the compressor 102 are connected to one another via refrigerant pipes to constitute a single refrigerant cycle. In addition to the aforementioned constituent elements, the refrigerant cycle may further include, e.g., various shapes of valves and additional refrigerant pipes as necessary.

The refrigerating compartment 110 contains a multi-purpose chamber 130 providing an independently partitioned storage space. The multi-purpose chamber 130 is separably coupled to a guide passage 134 to guide cold air into the multi-purpose chamber 130. A flap 133 is installed at an entrance of the guide passage 134. The flap 133 is hinged to the guide passage 134 and thus, an opening angle of the flap 133 is adjustable. The multi-purpose chamber 130 includes an inclined ceiling panel 132 made of an insulating material. The panel 132 is provided with a plurality of discharge holes, through which the cold air is supplied into the multi-purpose chamber 130.

A damper 109 is installed above the refrigerating compartment fan 106*b*. If the damper 109 is opened, the cold air generated from the refrigerating compartment evaporator 106 is uniformly supplied into the entire refrigerating compartment 110. On the contrary, if the damper 109 is closed, the cold air generated from the refrigerating compartment evaporator 106 is supplied only into the multi-purpose chamber 130. The damper 109 is driven to be opened or closed by a damper motor 109*a*.

Figure 2:
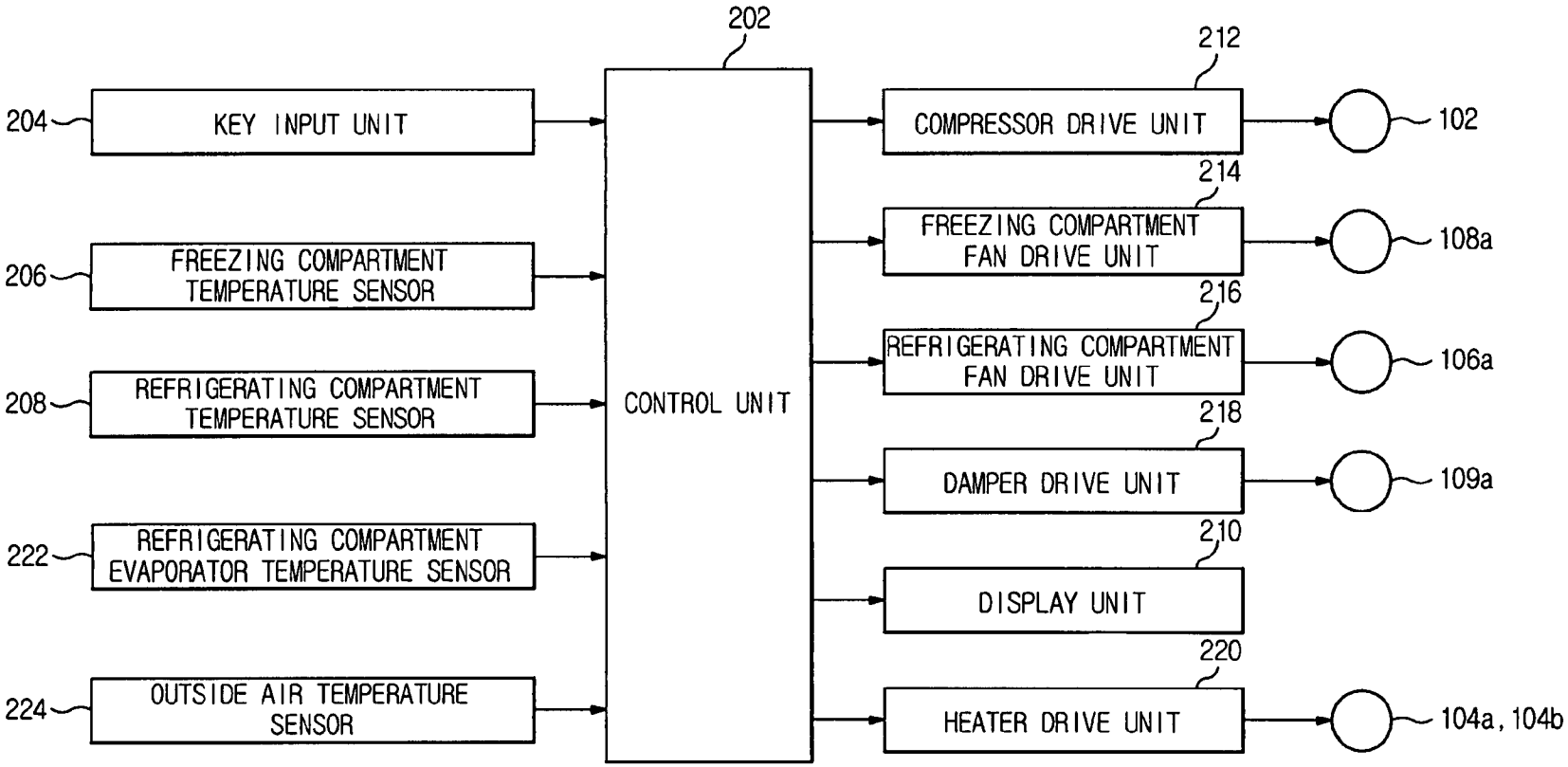
FIG. 2 is a block diagram illustrating a control system of the refrigerator illustrated in FIG. 1.

FIG. 2 is a block diagram illustrating a control system of the refrigerator illustrated in FIG. 1. As illustrated in FIG. 2, a key input unit 204, a freezing compartment temperature sensor 206, a refrigerating compartment temperature sensor 208, a refrigerating compartment evaporator temperature sensor 222, and an outside air temperature sensor 224 are connected to an input side of a control unit 202. The key input unit 204 includes a plurality of function keys to set operating conditions of the refrigerator 100, such as a cooling mode (strong cooling or weak cooling) or a desired temperature. The freezing compartment temperature sensor 206 and the refrigerating compartment temperature sensor 208 respectively sense interior temperatures of the freezing compartment 120 and the refrigerating compartment 110 and transmit the sensed results to the control unit 202. The refrigerating compartment evaporator temperature sensor 222 senses a refrigerant evaporation temperature of the refrigerating compartment evaporator 106 and transmits the sensed result to the control unit 202. The outside air temperature sensor 224 senses the exterior temperature of the refrigerator 100, i.e. the temperature of outside air in a space where the refrigerator 100 is installed and transmits the sensed result to the control unit 202.

A compressor drive unit 212, a freezing compartment fan drive unit 214, a refrigerating compartment fan drive unit 216, a damper drive unit 218, a display unit 210, and a defrosting heater drive unit 220 are connected to an output side of the control unit 202 to enable communication therebetween. These drive units respectively drive the compressor 102, the freezing compartment fan motor 108*a*, the refrigerating compartment fan motor 106*a*, the damper motor 109*a*, the refrigerating compartment heater 104*a*, and the freezing compartment heater 104*b*. The display unit 210, connected to the output side of the control unit 202 to enable communication therebetween, displays current operational states (temperature, etc.) or various preset values of the refrigerator.

The control unit 202 controls general operation of the refrigerator 100 in cooperation with the above described various constituent elements, to allow the refrigerating compartment 110 and the freezing compartment 120 to reach preset temperatures. In addition, in consideration of the temperature of outside air, the control unit 202 enables automated dehumidification of the refrigerating compartment 110, to prevent formation of dewdrops or frost at the inner surface of the refrigerating compartment 110. Alternatively, dehumidification may be manually performed whenever a user requests (sets) dehumidification, regardless of the temperature of outside air.

FIGS. 3A-3F are views illustrating dehumidification characteristics of the refrigerator according to the embodiment. In FIGS. 3A-3F, dehumidification involves an overlap section 302 in which heating the refrigerating compartment 110 for temperature compensation and cooling the refrigerating compartment 110 for dehumidification are performed simultaneously. This will be described in detail hereinafter.

Figures 3A, 3B, 3C, 3D, 3E, 3F:
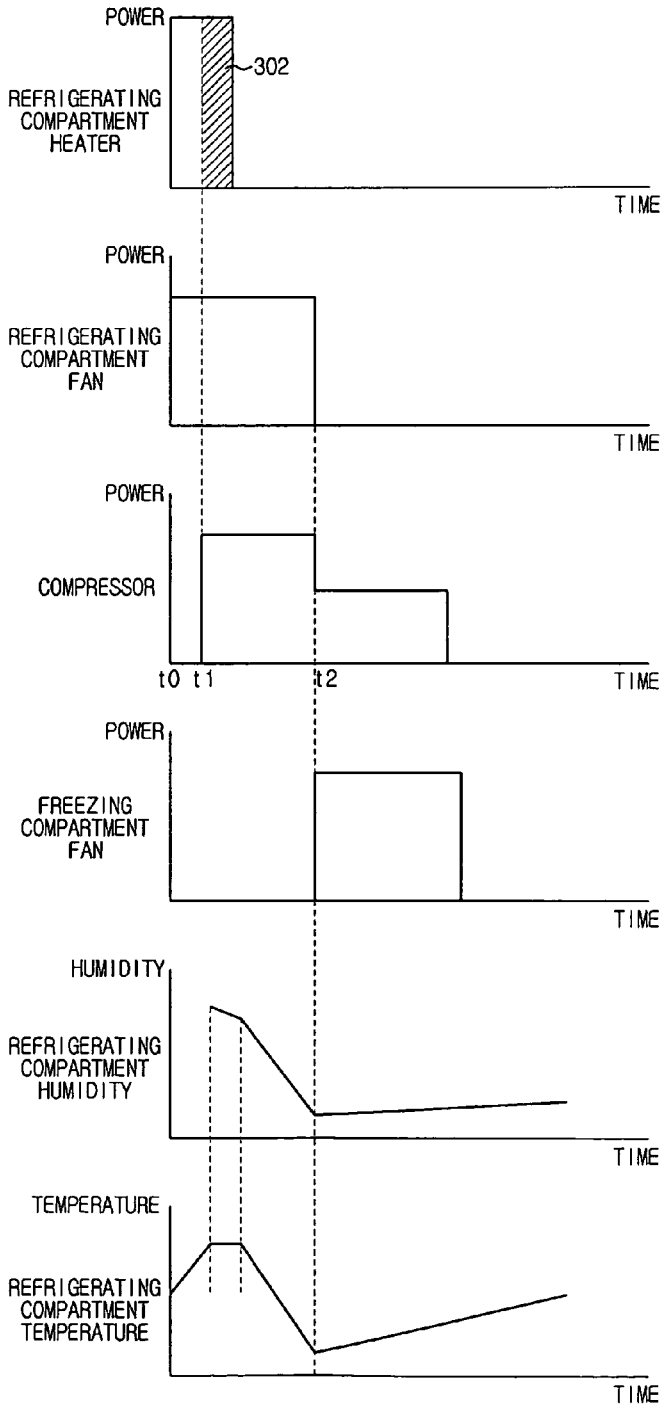
FIG. 3 is a view illustrating dehumidification characteristics of the refrigerator according to the embodiment.

For dehumidification, first, as illustrated in FIGS. 3A and 3B, the refrigerating compartment heater 104*a* and the refrigerating compartment fan 106*b* of the refrigerating compartment 110 are operated together. In FIG. 3C, after time t1 passes, the compressor 102 is operated to start cooling of the refrigerating compartment 110. As such, in the overlap section designated by reference numeral 302 of FIG. 3A, the refrigerating compartment heater 104*a* and the refrigerating compartment fan 106*b* of the refrigerating compartment 110 are operated together, enabling simultaneous implementation of cooling and temperature compensation of the refrigerating compartment 110. Here, 'overlap section' is a time section where a time section for cooling of the refrigerating compartment 110 and a time section for temperature compensation of the refrigerating compartment 110 overlap each other. If the refrigerating compartment heater 104*a* and the refrigerating compartment fan 106*b* of the refrigerating compartment 110 are operated together, cold air blown toward the refrigerating compartment 110 is dehumidified while passing through the surface of the refrigerating compartment evaporator 106 and immediately thereafter, is heated by the refrigerating compartment heater 104*a* for temperature compensation. In this way, the resulting dehumidified air is kept at a constant temperature. Thereafter, after cooling of the refrigerating compartment 110 is completed at time t2, the freezing compartment fan 108*b* is operated to start cooling of the freezing compartment 120. This cooling of the freezing compartment 120 may be omitted as necessary.

Considering the refrigerating compartment humidity curve of FIG. 3E and the refrigerating compartment temperature curve of FIG. 3F, in the overlap section 302 in which temperature compensation and cooling of the refrigerating compartment 110 are performed simultaneously, the humidity of the refrigerating compartment 110 is gradually lowered (see FIG. 3E), whereas the temperature of the refrigerating compartment 110 is kept constant rather than being lowered (see FIG. 3F). After the overlap section 302 passes, both the humidity and the temperature of the refrigerating compartment 110 are lowered.

If the temperature of the refrigerating compartment 110 is not kept constant in the overlap section 302 differently from illustration of FIG. 3F, the temperature of the refrigerating compartment 110 may be excessively lowered if the outside air has a low temperature. This cause more rapid temperature drop of the refrigerating compartment 110 in a section between the time t1 and the time t2 as compared to that illustrated in FIG. 3F and thus, the temperature of the refrigerating compartment 110 at time t3 may be much lower than that illustrated in FIG. 3F. This means that formation of ice or frost or freezing of food may occur in the refrigerating compartment 110. In addition, excessive temperature drop of the refrigerating compartment 110 may shorten a refrigerating compartment cooling time depending on the temperature of the refrigerating compartment 110, which may cause insufficient dehumidification (cooling) time of the refrigerating compartment 110, resulting in unsatisfactory dehumidification. However, with provision of the overlap section 302 as illustrated in FIGS. 3A-3F, temperature compensation may prevent excessive temperature drop of the refrigerating compartment 110, thereby preventing formation of ice or frost or freezing of food and achieving satisfactory dehumidification owing to sufficient dehumidification (cooling) time.

Figure 4:
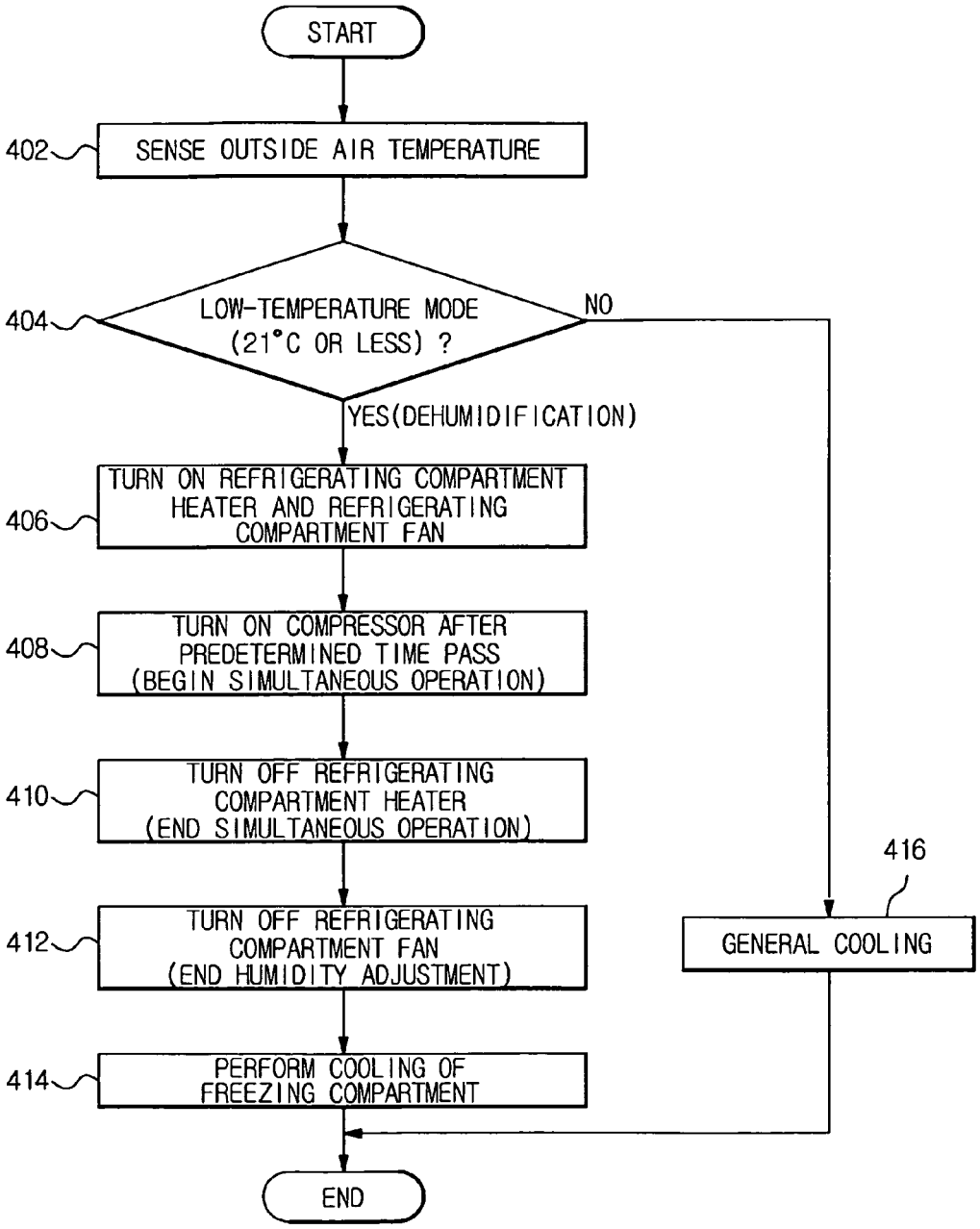
FIG. 4 is a view illustrating a dehumidification control method of the refrigerator under the characteristics of FIG. 3.

FIG. 4 is a view illustrating a dehumidification control method of the refrigerator under the characteristics of FIG. 3. As illustrated in FIG. 4, the control unit 202 detects the temperature of outside air around the refrigerator 100 via the outside air sensor 224 (402). If the temperature of outside air corresponds to a low-temperature mode that is known as having a negative effect on normal cooling (i.e. operation to reach a preset temperature) of the refrigerator 100 (for example, if the temperature of outside air is 21° C. or less) ('YES' in 404), dehumidification is performed (406 to 414). On the contrary, if the temperature of outside air does not correspond to the low-temperature mode, for example, if the temperature of outside air is more than 21° C., general cooling is performed (416).

During dehumidification 406 to 414, first, the refrigerating compartment heater 104*a* is operated for temperature compensation of the refrigerating compartment 110. Also, the refrigerating compartment fan 106*b* is operated until the compressor 102 begins operation, so as to supply heated air around the refrigerating compartment evaporator 106 into the refrigerating compartment 110 (406). This serves to reduce a temperature difference between cold air generated by new cooling and high-temperature air around the refrigerating compartment evaporator 106. The compressor 102 begins operation at time t1 to start cooling of the refrigerating compartment 110 (408). The overlap section 302 begins simultaneously with operation of the compressor 102. If a preset time of the overlap section 302 passes after the compressor 102 begins operation, the refrigerating compartment fan 106*b* is continuously operated, but the refrigerating compartment heater 104*a* is turned off to end the overlap section 302 (410). If completion of dehumidification of the refrigerating compartment 110 is judged, the refrigerating compartment fan 106*b* is turned off to end dehumidification (412). Here, a criterion to judge completion of dehumidification of the refrigerating compartment 110 may be previously set in the control unit 202 in consideration of cooling time of the refrigerating compartment 110, operation time of the refrigerating compartment heater 104*a*, the temperature of outside air, etc. Alternatively, dehumidification may be set to end when particular interior conditions of the refrigerating compartment 110 are satisfied. After completion of dehumidification, cooling of the freezing compartment 120 is selectively performed as necessary (414).

FIGS. 5A-5F are views illustrating dehumidification characteristics of the refrigerator according to another embodiment of the present disclosure. In FIGS. 5A-5F, dehumidification involves a section 502 in which the compressor 102 is turned off for a predetermined time after previous dehumidification (first dehumidification) (from t0 to t3) is completed and before following dehumidification (second dehumidification) (from t4 to t7) begins. This will be described in detail hereinafter.

Figure 5A:
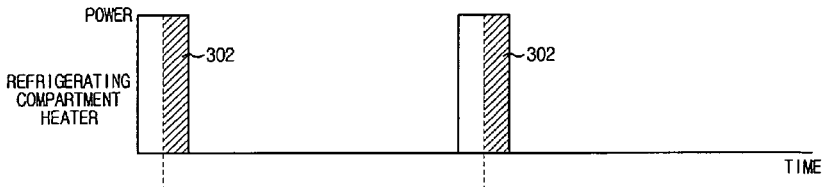
FIG. 5 is a view illustrating dehumidification characteristics of the refrigerator according to another embodiment of the present disclosure.
Figure 5B:
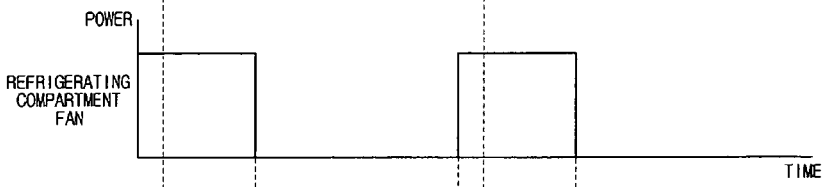
Figure 5C:
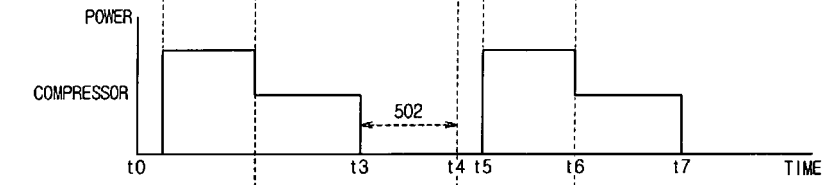
Figure 5D:
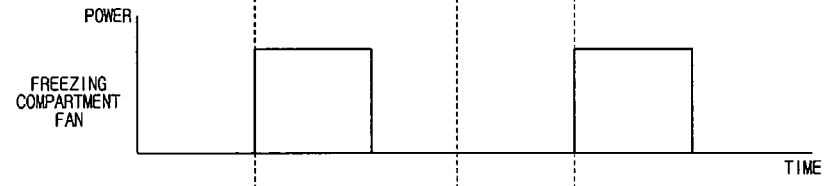
Figure 5E:
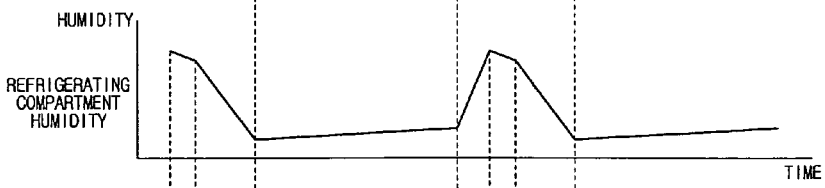
Figure 5F:
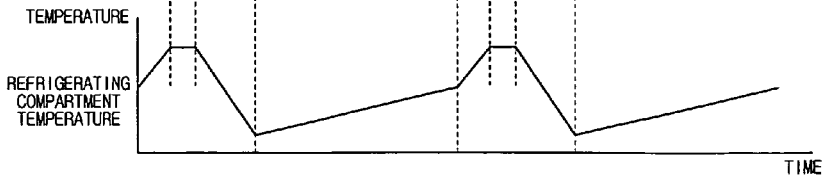

In FIGS. 5A-5F, previous dehumidification ends at time t3 and following dehumidification begins at time t4. Both the previous dehumidification and the following dehumidification are performed similar to that illustrated in FIGS. 3A-3F. For example, in the case of the following dehumidification, as illustrated in FIGS. 5A and 5B, the refrigerating compartment heater 104*a* and the refrigerating compartment fan 106*b* of the refrigerating compartment 110 are operated together at time t4. Thereafter, as illustrated in FIG. 5C, the compressor 102 begins operation at time t5 to start cooling of the refrigerating compartment 110. As such, in the overlap section designated by reference numeral 302 of FIG. 5A, the refrigerating compartment heater 104*a* and the refrigerating compartment fan 106*b* of the refrigerating compartment 100 are operated together, to enable simultaneous implementation of cooling and temperature compensation of the refrigerating compartment 110. Here, 'overlap section' is a time section where a time section for cooling of the refrigerating compartment 110 and a time section for temperature compensation of the refrigerating compartment 110 overlap each other. If the refrigerating compartment heater 104*a* and the refrigerating compartment fan 106*b* of the refrigerating compartment 110 are operated together, cold air blown toward the refrigerating compartment 110 is dehumidified while passing through the surface of the refrigerating compartment evaporator 106 and immediately thereafter, is heated by the refrigerating compartment heater 104*a* for temperature compensation. In this way, the resulting dehumidified air is kept at a constant temperature. Thereafter, after cooling of the refrigerating compartment 110 is completed at time t6, the freezing compartment fan 108*b* is operated to start cooling of the freezing compartment 120. This cooling of the freezing compartment 120 may be omitted as necessary.

In the embodiment illustrated in FIGS. 5A-5F, the compressor off section 502 is present between time t3 when previous dehumidification ends (i.e. compressor off time) and time t4 when following dehumidification begins (i.e. time when the refrigerating compartment heater 104*a* and the refrigerating compartment fan 106*b* are turned on). That is, the compressor off section 502 for a predetermined time t3 to t4 is present before the refrigerating compartment heater 104*a* and the refrigerating compartment fan 106*b* are turned on to perform following dehumidification. The compressor off section 502 serves to lengthen a low-humidity section obtained by previous dehumidification and to achieve pressure balance of a refrigerant cycle prior to beginning following dehumidification. That is, if following dehumidification (from t4 to t7) is begun excessively early in a state in which the humidity of the refrigerating compartment 110 is lowered by previous dehumidification (from t0 to t3), the following dehumidification is unnecessarily performed despite that the low-humidity section is continued by the previous dehumidification, resulting in unnecessary power consumption. Thus, providing the compressor off section 502 for a predetermined time after previous dehumidification and before following dehumidification prevents unnecessary power consumption due to hasty implementation of following dehumidification. In addition, the compressor off section 502 achieves pressure balance of a refrigerant cycle prior to performing following dehumidification, which ensures smooth operation of the compressor 102 when the compressor 102 begins operation for following dehumidification and also, prevents generation of shock due to pressure unbalance of a refrigerant cycle at the operation beginning time of the compressor 102, extending the lifespan of the compressor 102.

Figure 6:
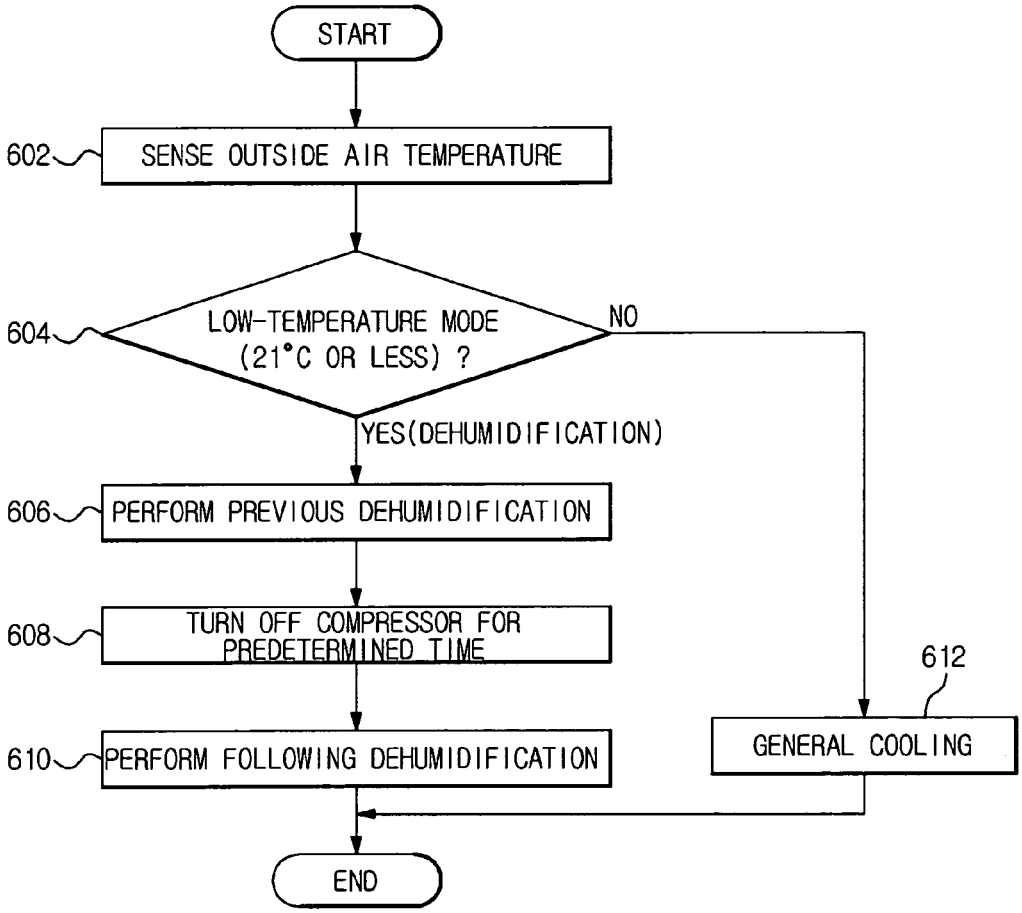
FIG. 6 is a view illustrating a dehumidification control method of the refrigerator under the characteristics of FIG. 5.

FIG. 6 is a view illustrating a dehumidification control method of the refrigerator under the characteristics of FIGS. 5A-5F. As illustrated in FIG. 6, the control unit 202 detects the temperature of outside air around the refrigerator 100 using the outside air temperature sensor 224 (602). If the temperature of outside air corresponds to a low-temperature mode that is known as having a negative effect on normal cooling (i.e. operation to reach a preset temperature) of the refrigerator 100 (for example, if the temperature of outside air is 21° C. or less) ('YES' in 604), dehumidification is performed (606 to 610). On the contrary, if the temperature of outside air does not correspond to the low-temperature mode, for example, if the temperature of outside air is more than 21° C., general cooling is performed (612).

In FIG. 6, dehumidification 606 to 610 involves previous dehumidification 606 and following dehumidification 610. The compressor off section (502 of FIG. 5C) in which the compressor 102 is turned off for a predetermined time is set between the previous dehumidification 606 and the following dehumidification 610 (608). The previous dehumidification 606 and the following dehumidification 610 are performed as mentioned in the above description of FIGS. 5A-5F.

Thus, providing the compressor off section (502 of FIG. 5C) for a predetermined time after the previous dehumidification 606 and before the following dehumidification 610 prevents unnecessary power consumption due to hasty implementation of the following dehumidification 610. In addition, the compressor off section (502 of FIG. 5C) achieves pressure balance of a refrigerant cycle prior to performing the following dehumidification 610, which ensures smooth operation of the compressor 102 when the compressor 102 begins operation for the following dehumidification 610 and also, prevents generation of shock due to pressure unbalance of a refrigerant cycle at the operation beginning time of the compressor 102, extending the lifespan of the compressor 102.

Figure 7:
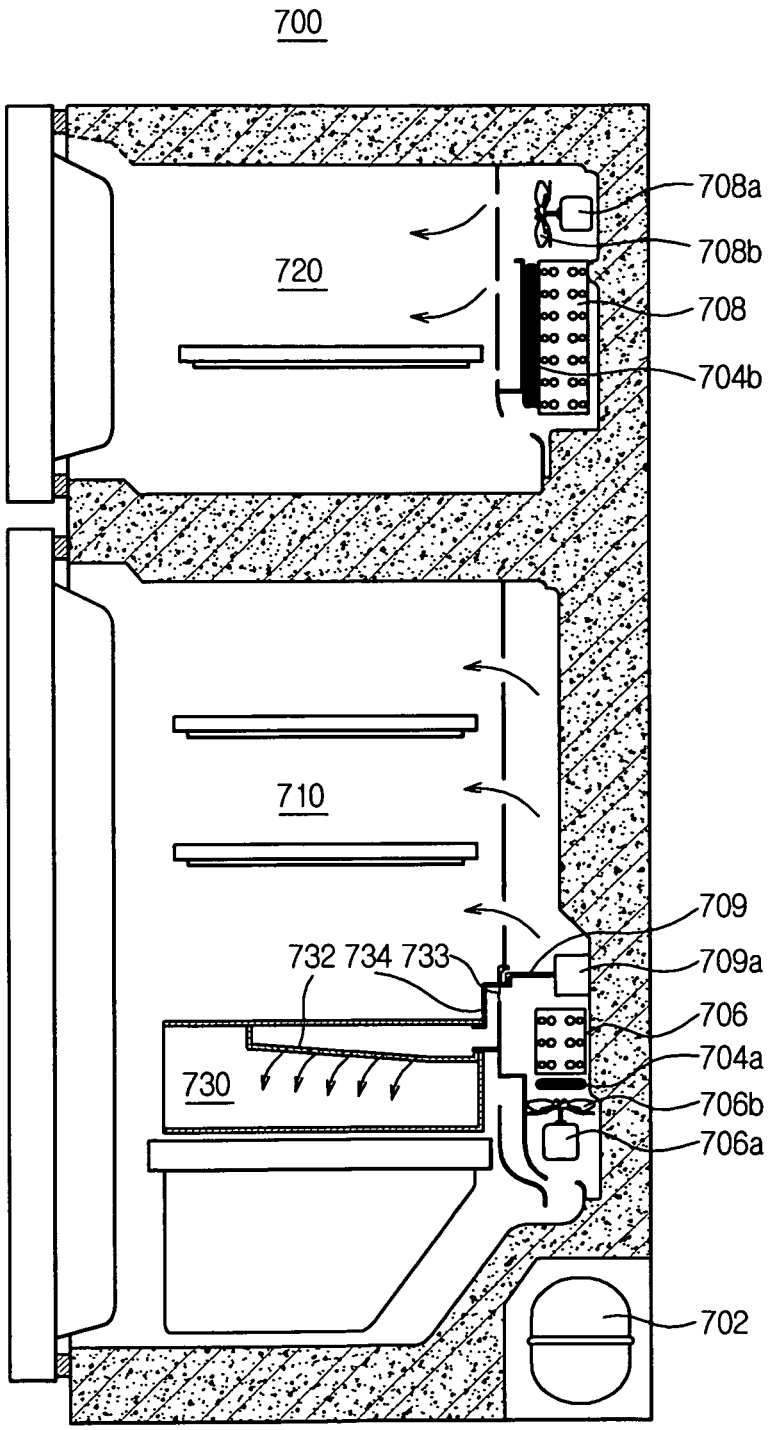
FIG. 7 is a view illustrating a configuration of a refrigerator according to a further embodiment of the present disclosure.

FIG. 7 is a view illustrating a configuration of a refrigerator according to a further embodiment of the present disclosure. As illustrated in FIG. 7, the refrigerator 700 according to the embodiment of the present disclosure includes a lower refrigerating compartment 710 and an upper freezing compartment 720. The refrigerating compartment 710 contains a refrigerating compartment evaporator 706, a refrigerating compartment fan motor 706*a*, a refrigerating compartment fan 706*b*, and a refrigerating compartment heater 704*a*, which are arranged in an innermost cold air generating space thereof (the right region of FIG. 7). The refrigerating compartment heater 704*a* serves to prevent excessive temperature drop in the refrigerating compartment 710 via temperature compensation during dehumidification to control humidity. In a general cooling mode, the refrigerating compartment heater 704*a* also serves to melt and remove frost formed at a surface of the refrigerating compartment evaporator 706. The refrigerating compartment evaporator 706 is located upstream of a blowing direction of the refrigerating compartment fan 706*b*, and the refrigerating compartment heater 704*a* is located downstream of the blowing direction. With this arrangement, as cold air blown by the refrigerating compartment fan 706*b* passes through the refrigerating compartment evaporator 706, the temperature and absolute humidity of the cold air are lowered by dehumidification at the surface of the refrigerating compartment evaporator 706. Then, the cold air is heated to a higher temperature by the refrigerating compartment heater 704*a* (i.e., temperature compensation is performed). Cold air generated from the refrigerating compartment evaporator 706 is blown into the refrigerating compartment 710 by rotation of the refrigerating compartment fan 706*b*. The freezing compartment 720 contains a freezing compartment evaporator 708, a freezing compartment fan motor 708*a*, a freezing compartment fan 708*b*, and a freezing compartment heater 704*b*, which are arranged in an innermost cold air generating space thereof (the right region of FIG. 7). The freezing compartment heater 704*b* serves to melt and remove frost formed at a surface of the freezing compartment evaporator 708. Cold air generated from the freezing compartment evaporator 708 is blown into the freezing compartment 720 by rotation of the freezing compartment fan 708*b*.

Expansion devices (capillary tubes, expansion valves, etc.) (not shown) to depressurize and expand a refrigerant are installed at an entrance of the refrigerating compartment evaporator 706 and an entrance of the freezing compartment evaporator 708. A condenser (not shown) is provided at an exit of a compressor 702. The refrigerating compartment evaporator 706, the expansion device for the refrigerating compartment evaporator 706, the freezing compartment evaporator 708, the expansion device for the freezing compartment evaporator 708, the condenser, and the compressor 702 are connected to one another via refrigerant pipes to constitute a single refrigerant cycle. In addition to the aforementioned constituent elements, the refrigerant cycle may further include, e.g., various shapes of valves and additional refrigerant pipes as necessary.

The refrigerating compartment 710 contains a multi-purpose chamber 730 providing an independently partitioned storage space. The multi-purpose chamber 730 is separably coupled to a guide passage 734 to guide cold air into the multi-purpose chamber 730. A flap 733 is installed at an entrance of the guide passage 734. The flap 733 is hinged to the guide passage 734 and thus, an opening angle of the flap 733 is adjustable. The multi-purpose chamber 730 includes an inclined ceiling panel 732 made of an insulating material. The panel 732 is provided with a plurality of discharge holes, through which the cold air is supplied into the multi-purpose chamber 730.

A damper 709 is installed above the refrigerating compartment fan 706*b*. If the damper 709 is opened, the cold air generated from the refrigerating compartment evaporator 706 is uniformly supplied into the entire refrigerating compartment 710. On the contrary, if the damper 709 is closed, the cold air generated from the refrigerating compartment evaporator 706 is supplied only into the multi-purpose chamber 730. The damper 709 is driven to be opened or closed by a damper motor 709*a*.

Unlike in the refrigerating compartment 110 of FIG. 1, the refrigerating compartment heater 704*a* is located upstream of a blowing direction of the refrigerating compartment fan 706*b* and the refrigerating compartment evaporator 706 is located downstream of the blowing direction. That is, although the refrigerator 100 illustrated in FIG. 1 has the arrangement order of the refrigerating compartment fan 106*b*—the refrigerating compartment evaporator 106—the refrigerating compartment heater 104*a*, the refrigerator 700 illustrated in FIG. 7 has the arrangement order of the refrigerating compartment fan 706*b*—the refrigerating compartment heater 704*a*—the refrigerating compartment evaporator 706. With this configuration, cold air blown by the refrigerating compartment fan 706*b* is heated to a higher temperature by the refrigerating compartment heater 704*a* prior to passing through the refrigerating compartment evaporator 706. Thus, the air maintaining a constant absolute humidity passes the surface of the refrigerating compartment evaporator 706, thereby being dehumidified to have a lower temperature and absolute humidity. Although the arrangement order of the refrigerating compartment fan 106*b*—the refrigerating compartment evaporator 106—the refrigerating compartment heater 104*a* of FIG. 1 provides more greater dehumidification effects than the arrangement order of FIG. 7 given that cold air is first heated and then, dehumidified, the arrangement order of the refrigerating compartment fan 706*b*—the refrigerating compartment heater 704*a*—the refrigerating compartment evaporator 706 of FIG. 7 has been frequently used in refrigerators and therefore, may be advantageous because it achieves dehumidification effects according to the embodiments even using conventional configurations.

As is apparent from the above description, one or more embodiments include a dehumidification control method of a refrigerator to effectively perform both temperature compensation and dehumidification of a refrigerating compartment so as to prevent formation of dewdrops in the refrigerating compartment.

Although embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A dehumidification control method of a refrigerator comprising:

detecting a temperature of outside air around the refrigerator to determine if the detected temperature corresponds to a low-temperature mode requiring dehumidification; and when the detected temperature corresponds to the low-temperature mode, heating a refrigerating compartment by operating a refrigerating compartment heater and a refrigerating compartment fan together for a first predetermined time for the dehumidification;

after the first predetermined time, and during the heating, initiating cooling of the refrigerating compartment by operating a compressor to perform temperature compensation by heating the refrigerating compartment and to perform dehumidification by cooling the refrigerating compartment;

wherein the heating of the refrigerating compartment and the cooling of the refrigerating compartment are controlled to partially overlap each other for a second predetermined time.

2. A refrigerator comprising:

a compressor to compress a refrigerant;

a refrigerator compartment;

a refrigerating compartment evaporator to cool air in the refrigerating compartment;

a refrigerating compartment heater to heat air around the refrigerating compartment evaporator;

a refrigerating compartment fan to blow the air around the refrigerating compartment evaporator and into the refrigerating compartment; and a control unit configured to perform, when detected temperature of outside air around the refrigerator corresponds to a low-temperature mode, heating of the refrigerating compartment by operating the refrigerating compartment heater and the refrigerating compartment fan together for a first predetermined time for a dehumidification, and after the first predetermined time, and during the heating, initiating cooling of the refrigerating compartment by operating the compressor to perform temperature compensation by heating the refrigerating compartment and to perform dehumidification by cooling the refrigerating compartment, wherein the heating of the refrigerating compartment and the cooling of the refrigerating compartment are controlled to partially overlap each other for a second predetermined time.

3. The refrigerator according to claim 2, wherein the refrigerating compartment evaporator is located upstream of an air stream generated by rotation of the refrigerating compartment fan and the refrigerating compartment heater is located downstream of the air stream.

4. The refrigerator according to claim 2, wherein the refrigerating compartment heater is located upstream of an air stream generated by rotation of the refrigerating compartment fan and the refrigerating compartment evaporator is located downstream of the air stream.

5. The refrigerator according to claim 2, wherein the refrigerating compartment includes a multi-purpose chamber providing a partitioned storage space, the multi-purpose chamber is separably coupled to a guide passage to guide cold air from the refrigerating compartment evaporator into the multi-purpose chamber, and a flap at an entrance of the guide passage, the flap being hinged to the guide passage.

6. The refrigerator according to claim 5, further comprising a damper above the refrigerating compartment fan, wherein, when the damper is opened, the cold air is supplied into the refrigerating compartment, when the damper is closed, the cold air is supplied only into the multi-purpose chamber, and the damper is driven to be opened or closed by a damper motor.

7. The refrigerator according to claim 2, further comprising:

a key input unit including a plurality of function keys to set operating conditions of the refrigerator;

a freezing compartment temperature sensor and a refrigerating compartment temperature sensor to sense interior temperatures of a freezing compartment and the refrigerating compartment, respectively, and transmit the sensed results to the control unit;

a refrigerating compartment evaporator temperature sensor to sense a refrigerant evaporation temperature of the refrigerating compartment evaporator and transmit the sensed result to the control unit; and an outside air temperature sensor to sense an air temperature outside of the refrigerator and transmit the sensed result to the control unit.

8. The refrigerator according to claim 7, wherein the control unit enables automated dehumidification of the refrigerating compartment, to prevent formation of dewdrops or frost at an inner surface of the refrigerating compartment.

9. The refrigerator according to claim 7, wherein the control unit enables dehumidification whenever a user requests dehumidification, regardless of the air temperature outside of the refrigerator.

* * * * *